US005853212A

United States Patent [19]

Daniel

[11] Patent Number: 5,853,212

[45] Date of Patent: Dec. 29, 1998

[54] SNOW SKI WRAP

[76] Inventor: Dianne C. Daniel, 2515 Sonnington Dr., Dublin, Ohio 43016

[21] Appl. No.: 671,490

[22] Filed: Jun. 27, 1996

[51] Int. Cl.[6] ..... A63C 11/02

[52] U.S. Cl. ..... 294/147; 294/141; 294/165; 24/16 R

[58] Field of Search ..... 294/141, 146, 294/147, 148, 150, 165, 166; 24/16 PB, 16 R, 17 AP, 30.5 P, 30.5 T, 27, 300; 428/364, 372, 373, 375, 379, 398; 132/273, 275; 280/814

[56] References Cited

U.S. PATENT DOCUMENTS

| | | | |
|---|---|---|---|
| D. 310,909 | 10/1990 | Bradtl | D3/36 |
| 2,118,875 | 5/1938 | Windheim | 224/5 |
| 2,530,695 | 11/1950 | Helmert | 224/5 |
| 3,257,054 | 6/1966 | Miesel | 224/56 |
| 3,426,393 | 2/1969 | Mead | 24/30.5 T |
| 3,768,711 | 10/1973 | Wilkinson | 224/45 |
| 3,947,927 | 4/1976 | Rosenthal | 24/81 SK |
| 3,960,302 | 6/1976 | Mazzoni | 224/45 S |
| 4,015,762 | 4/1977 | Mendillo | 224/45 S |
| 4,120,437 | 10/1978 | Hara | 224/45 |
| 4,463,885 | 8/1984 | Ball et al. | 224/250 |
| 4,483,470 | 11/1984 | Cousins | 224/257 |
| 4,484,378 | 11/1984 | Kimura et al. | 24/30.5 T |
| 4,488,748 | 12/1984 | Burkes | 294/147 |
| 4,531,661 | 7/1985 | Santy | 224/191 |
| 4,553,779 | 11/1985 | Shortridge | 294/147 |
| 4,856,689 | 8/1989 | Stone | 224/218 |
| 5,056,820 | 10/1991 | Des Prez | 294/147 |
| 5,104,017 | 4/1992 | Vandagriff | 224/205 |
| 5,190,336 | 3/1993 | Palz | 294/147 |
| 5,199,135 | 4/1993 | Gold | 24/17 AP |
| 5,437,401 | 8/1995 | Seltzer | 224/151 |
| 5,468,036 | 11/1995 | Brown | 294/147 |
| 5,590,422 | 1/1997 | Henderson | 132/273 |

OTHER PUBLICATIONS

Zippy, no date, Child's toy foam rubber product.

Kematic Industries & Co., No date, Hair care foam rubber product.

*Primary Examiner*—Dean Kramer

*Attorney, Agent, or Firm*—Standley & Gilcrest

[57] ABSTRACT

An apparatus and method for bundling and carrying snow ski equipment is disclosed. The present invention is comprised of an elongate piece of first material having flexible qualities with a flexible strip of second, more rigid, and bendable material enclosed within the first material. The apparatus can be twist-tied around the ski equipment for relatively easy transport.

8 Claims, 2 Drawing Sheets

SNOW SKI WRAP

BACKGROUND AND SUMMARY OF THE INVENTION

The present invention relates generally to equipment transportation devices and methods, and more particularly, to a snow ski wrap for easy transport of snow ski equipment.

The joys of snow skiing can often be shadowed by the difficulties of carrying and transporting the heavy and bulky skis and ski poles. Known ski equipment carrying devices such as those disclosed in U.S. Pat. Nos.: 3,960,302; 4,888,748; 2,530,695; 3,257,054; 5,468,036; 2,118,875; 3,768,711; 4,120,437; 4,463,885; 4,015,762; 4,856,689; 5,190,336; 5,437,401; 4,531,661; 3,947,927 all require some sort of elaborate buckling, strapping, or Velcro-connecting means for carrying ski equipment. All these known devices are lacking because:

1) they require relatively time-consuming construction prior to use;
2) they cannot be easily used while wearing heavy snow gloves;
3) they are all relatively detailed in construction;
4) some fail to secure the ski equipment while also preventing scratch damage to the equipment; and
5) many known devices are not easily stored on the person while skiing.

The present invention is comprised of a tube-like, elongate piece of first material having characteristics including, but not limited to, soft, lightweight, and flexible qualities, such as found in sponge (or foam) rubber (any variation of first materials of the rubber-like variety would work well depending on the application and/or particular manufacturing technique). The tube-like, elongate piece of first material encloses a flexible strip of second material having characteristics including, but not limited to, flexible qualities that allow the strip to retain its new shape when bent, such as a flexible wire. In the preferred embodiment, the tube-like, elongate piece of first material is a sponge (or foam) rubber piece which can be easily grabbed, or handled, while wearing heavy ski gloves. The flexible strip is bendable which allows the elongate rubber piece to retain its shape when bent. The elongate rubber piece is then twisted together to secure the snow skis. A second ski wrap may be similarly used to secure the opposite end of the snow skis. A pair of ski poles is then placed in the spaces formed by the twisting of the ski wraps securing the snow skis. The ski wraps are again twisted to secure the ski poles in place. The skier then grabs the ski poles and easily transports the ski equipment.

The rubber material preferably has a non-slip exterior surface which allows the ski equipment to be secured within the invention. Additionally, the rubber wrap does not scratch the expensive ski equipment while in contact with the equipment. The rubber wrap also slightly elevates the ski equipment from the ground which prevents damage to the ski equipment by abrasive asphalt or gravel.

The efficient design of the snow ski wrap allows for relatively easy manufacture. The design of the present invention also allows for easy maintenance, and storage, of the ski wrap when not in use. When not in use, the present invention may be stored in a user's pocket while skiing.

The present invention provides a much needed apparatus and method of easily securing and carrying ski equipment as well as other apparatus. In addition to the features mentioned above, objects and advantages of the present invention will be readily apparent upon a reading of the following description.

BRIEF DESCRIPTION OF THE DRAWINGS

Novel features and advantages of the present invention, in addition to those mentioned above, will become apparent to those skilled in the art, from a reading of the following detailed description in conjunction with the accompanying drawings wherein similar reference characters refer to similar parts and in which.

DETAILED DESCRIPTION OF THE PREFERRED EMBODIMENTS

The preferred system herein described is not intended to be exhaustive or to limit the invention to the precise forms disclosed. They are chosen and described to explain the principles of the invention, and the application of the method to practical uses, so that others skilled in the art may practice the invention.

The present invention is comprised of a tube-like, elongate piece of first material 12 having characteristics including, but not limited to, soft, lightweight, and flexible qualities, such as found in sponge (or foam) rubber (any variation of first materials of the rubber-like variety would work well depending on the application and/or particular manufacturing technique). The tube-like, elongate piece 12 of first material encloses a flexible strip 14 of second material having characteristics including, but not limited to, flexible qualities that allow the strip 14 to retain its new shape when bent, such as a flexible wire. In the preferred embodiment, the tube-like, elongate piece 12 of first material is a sponge (or foam) rubber piece 12, and the flexible strip 14 of second material is a strip 14 of flexible metal.

Figure 1:
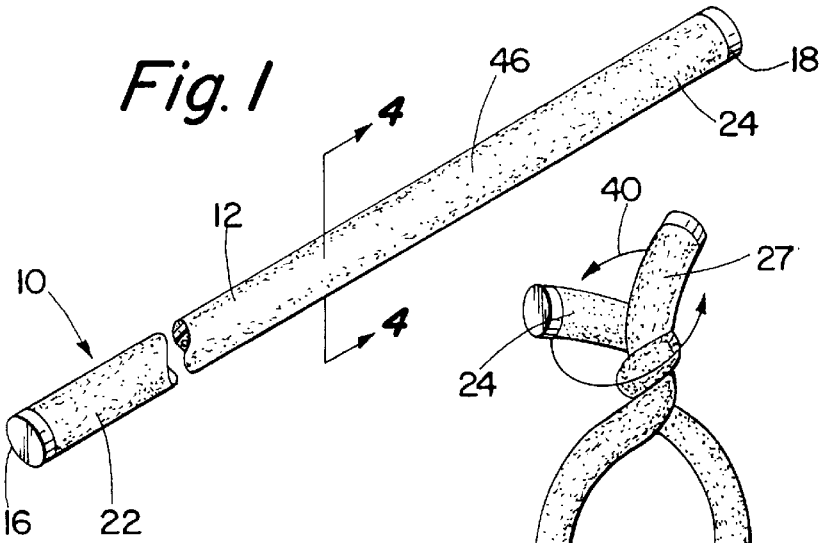
FIG. 1 is a perspective view of the snow ski wrap of the present invention.

Referring in more detail to the drawings, and particularly FIG. 1, the preferred embodiment of the snow ski wrap 10 of the present invention is comprised of a tube-like, elongate piece of sponge, or foam, rubber 12, a strip 14 of flexible metal enclosed within the length of the elongate piece of foam rubber 12, and a first end cap 16 placed over the first end 22 of the elongate piece of foam rubber 12, and a second end cap 18 placed over the opposite end 24 of the elongate piece of foam rubber 12.

It is preferred that the elongate piece of foam rubber 12 be formed of a long tube-like form, preferably between 10 to 50 inches long, as illustrated in FIG. 1. It is also preferred that the elongate piece of foam rubber 12 have a diameter between 0.5 inch to 2.5 inches so that the snow ski wrap 10 is capable of being easily grabbed and manipulated while a user is wearing heavy ski gloves. Several well known manufacturing methods may be used to produce the present invention. A preferred method is to co-extrude the rubber piece 12 onto the flexible strip 14.

Figure 4:
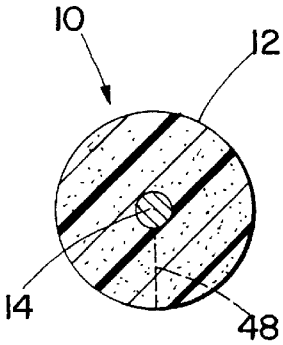
FIG. 4 is a cross sectional taken along lines 4—4 in FIG. 1.

The flexible strip 14 of metal can be easily bent, yet the strip 14 has a degree of rigidity which allows the snow ski wrap 10 to retain its form when bent or straightened. In a preferred embodiment, the strip 14 is a solid, 14 gauge, wire. FIG. 4 illustrates a cross-section of one end of the ski wrap 10, showing the enclosed strip 14 of wire.

Figure 2:
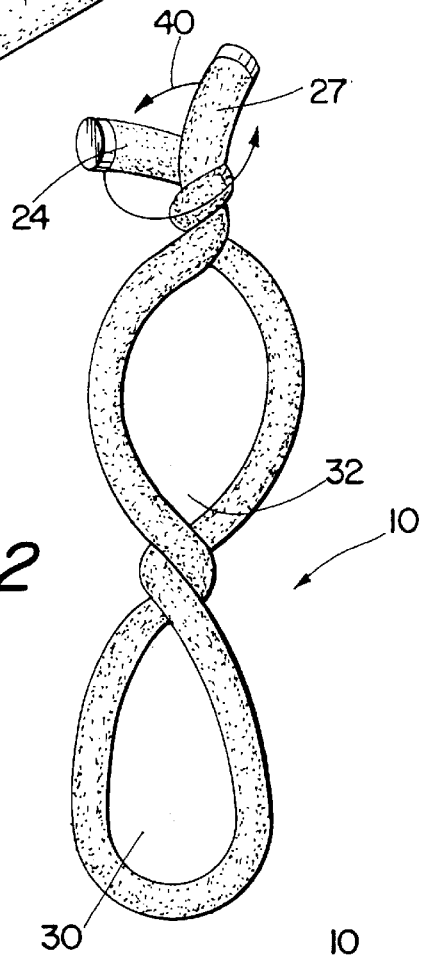
FIG. 2 is a plan view of the snow ski wrap of the present invention in its twisted shape.
Figure 3:
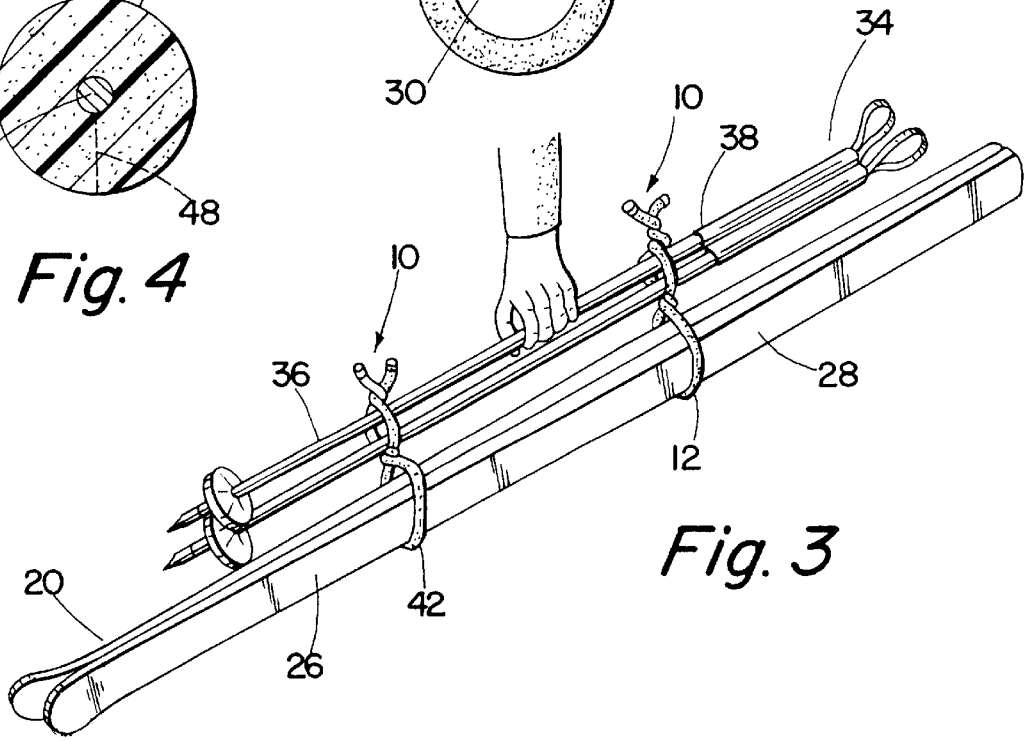
FIG. 3 is a perspective view of the snow ski wrap of the present invention in use.

The ski wrap 10 is used by straightening the foam rubber piece 12 as illustrated in FIG. 1. Next the skier places the two skis 20 together, as illustrated in FIG. 3. The skier then takes the ski wrap 10 of the present invention and grabs the ends 22, 24 of the foam rubber piece 12 and wraps the elongate piece of foam rubber 12 around the first ends 26 of the two skis 20. The skier/user then "twist-ties" the foam rubber piece 12 around the first ends 26 of the two skis. Twist-tying refers to interlocking the foam rubber piece 12 by twisting the ends 22, 24 of the foam rubber piece 12 together in the direction of the arrows 40 in FIG. 2. (The ends 22, 24 can also be twisted in the opposite direction of the arrows 40).

The skier/user then wraps and twist-ties a second ski wrap 10 around the second ends 28 of the skis 20. This twist-tying motion creates a loop or hole 30 in which the skis 20 are secured. This twist-tying motion also create a space 32 in which the ski poles 34 can be placed. The skier/user may then place a pair of ski poles 34 in the space 32 formed by the twist-tying of the elongate pieces of foam rubber 12. The ski poles 34 are secured in place by wrapping and twist-tying the elongate pieces of foam rubber 12, a second time, around the ends 36, 38 of the pair of ski poles 34.

The skier/user carries the ski equipment by grasping the ski poles 34 between the first and second elongate pieces of foam rubber (42, 44 respectively).

The present invention is also unique as the elongate piece of foam rubber 12 has a non-slip exterior 46 in contact with the skis 20 and ski poles 34. The non-slip exterior 46 firmly secures the ski equipment in place to prevent the equipment from falling out of the loops 30. The foam rubber also protects the ski equipment from being scratched by the carrying means. Other known ski carrying equipment utilize straps made of leather, or other material, which can scratch the surface of the ski equipment. In the present invention, the insulation provided by the foam rubber protects the finished surfaces of the ski equipment from damage while in transit. Not only does the present invention prevent scratching from the ski carrier, the snow ski wrap 10 can be used to keep the snow skis 20 off the abrasive ground or pavement. A snow ski wrap 10 is preferably made with a foam rubber piece 12 with a radius 48 large enough to elevate the skis 20 off the hard ground.

The present invention has other beneficial uses. More particularly, the present invention is capable of being used for bundling and carrying elongate articles. For example, the present invention 10 is capable of separately bundling rods, baseball bats, sticks of wood, garden hoses or practically any other elongate article.

Figure 5:
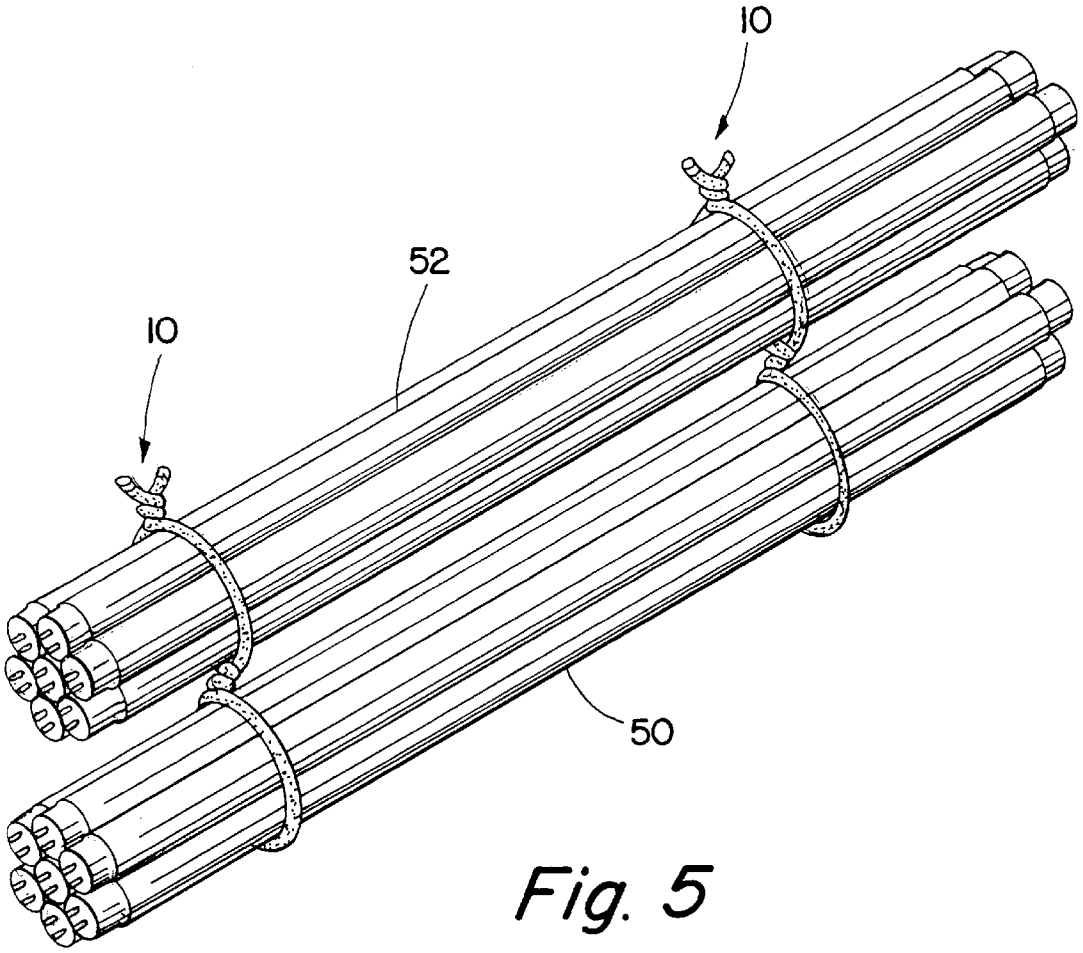
FIG. 5 is a perspective view of the present invention in use as a bundling apparatus.

As illustrated, the present invention 10 can be used to bundle articles in separate groups. For example, as illustrated by FIG. 5, the first loop can be used to bundle and carry rods of one type 50 while the second loop can be used to bundle and carry rods of a second type 52. The present invention 10 is unique as it may be easily grabbed and manipulated while wearing heavy gloves. Additionally, the foam rubber exterior 46 protects the bundled articles from being scratched by the carrying means. As discussed above, the foam rubber also insulates the bundled elongate articles, such as the rods 50, 52 illustrated in FIG. 5, from damage when placed on the ground.

Figure 6:
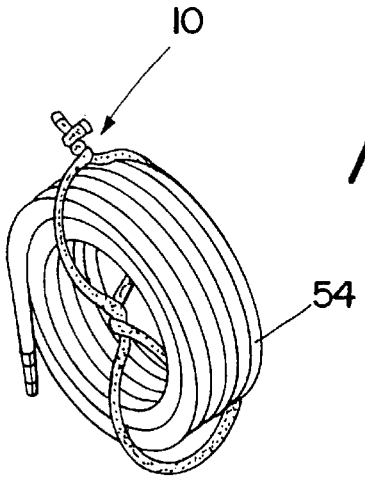
FIG. 6 is a perspective view of the present invention in use as a garden hose restraint and carrying means.

FIG. 6 illustrates the present invention in use as a garden hose 54 restraint and carrying means. The present invention may also be used to secure items in place. For example, the present invention may be used to secure a bicycle to a bike rack.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. A snow ski wrap for securing and transporting a pair of skis and ski poles, comprising:

an elongate piece of first material having flexible qualities;

a flexible strip of second material enclosed within said elongate piece of first material;

wherein said elongate piece of first material is capable of being wrapped around a pair of skis and ski poles for securing said skis and ski poles for transport; and wherein said flexible strip of second material can be easily bent and wherein said flexible strip of second material has a degree of rigidity which allows said snow ski wrap to retain its form when bent or straightened.

2. A snow ski wrap according to claim 1, wherein:

said elongate piece of first material is an elongate piece of rubber, having a first and second end; and wherein said flexible strip of second material is a strip of flexible metal.

3. A snow ski wrap as recited in claim 2, wherein said elongate piece of rubber is in the shape of a long tube-like form.

4. A snow ski-wrap as recited in claim 3, wherein said elongate piece of rubber has a diameter between 0.5 inch to 2.5 inches; and wherein said snow ski wrap is capable of being easily grabbed and manipulated while a user is wearing heavy ski gloves.

5. A snow ski wrap as recited in claim 2, wherein said elongate piece of rubber has a non-slip exterior for immovably securing said skis and ski poles.

6. A method for securing a pair of skis and ski poles for transport, comprising:

placing said pair of skis together;

wrapping a first elongate, piece of first material around the first ends of said pair of skis, said first, elongate, piece of first material enclosing a strip of flexible metal;

twist-tying said first elongate, piece of first material around said first ends of said pair of skis;

wrapping a second elongate, piece of first material around the second ends of said pair of skis, said second, elongate, piece of first material enclosing a strip of flexible metal;

twist-tying said second elongate, piece of first material around said second ends of said pair of skis;

placing a pair of ski poles in the space formed by said twist-tying of said first and second elongate, pieces of first material;

twist-tying said first elongate, piece of first material around the first ends of said pair of ski poles; and twist-tying said second elongate, piece of first material around the second ends of said pair of ski poles.

7. The method as recited in claim 6, further comprising the steps of:

grasping the ski poles between said first and second elongate, pieces of first material; and transporting said pair of ski and ski poles.

8. A snow ski wrap for securing and transporting a pair of skis and ski poles, comprising:

an elongate piece of foam rubber, having a first and second end;

a strip of flexible metal enclosed within the length of said elongate piece of foam rubber;

a first end cap placed over said first end of said elongate piece of foam rubber;

a second end cap placed over said second end of said elongate piece of foam rubber;

wherein said elongate piece of foam rubber is capable of being wrapped around a pair of skis and ski poles for securing said skis and ski poles for transport;

wherein said strip of flexible metal can be easily bent and wherein said strip of flexible metal has a degree of rigidity which allows said snow ski wrap to retain its form when bent or straightened;

wherein said elongate piece of foam rubber is in the shape of a long tube-like form;

wherein said elongate piece of foam rubber has a diameter between 0.5 inch to 2.5 inches;

wherein said snow ski wrap is capable of being easily grabbed and manipulated while a user is wearing heavy ski gloves; and wherein said elongate piece of foam rubber has a non-slip exterior for immovably securing said pair of skis and ski poles.

* * * * *